United States Patent [19]

Majima et al.

[11] Patent Number: 4,547,392

[45] Date of Patent: Oct. 15, 1985

[54] METHOD FOR MAKING A TRANSFERRABLE DYE MEDIUM

[75] Inventors: Osamu Majima; Shigemichi Honda, both of Tokyo, Japan

[73] Assignee: Sony Corporation, Tokyo, Japan

[21] Appl. No.: 586,654

[22] Filed: Mar. 9, 1984

Related U.S. Application Data

[63] Continuation of Ser. No. 400,919, Jul. 22, 1982, abandoned.

[30] Foreign Application Priority Data

Jul. 25, 1981 [JP] Japan ..... 56-109807[U]

[51] Int. Cl.[4] ..... B05D 1/28

[52] U.S. Cl. ..... 427/40; 427/148; 427/350; 427/361; 427/363; 427/366; 118/50; 118/642; 118/101

[58] Field of Search ..... 427/39, 13, 153, 148, 427/40, 296, 41, 350, 361, 363, 366; 118/50, 642, 643, 117, 101, 202, 60

[56] References Cited

U.S. PATENT DOCUMENTS

| | | | |
|---|---|---|---|
| 2,321,939 | 6/1943 | Quinn | 427/366 X |
| 2,839,025 | 6/1958 | Burke et al. | 118/642 X |
| 3,019,130 | 1/1962 | Hornbostel | 427/366 X |
| 3,565,039 | 2/1971 | Remer | 118/643 |
| 3,667,422 | 6/1972 | Saladen | 118/60 X |
| 4,058,644 | 11/1977 | Devries et al. | 427/148 X |

FOREIGN PATENT DOCUMENTS

| | | |
|---|---|---|
| 1115082 | 5/1966 | United Kingdom . |
| 1195727 | 6/1967 | United Kingdom . |

*Primary Examiner*—John P. McIntosh

*Attorney, Agent, or Firm*—Lewis H. Eslinger; Alvin Sinderbrand

[57] ABSTRACT

A transferable dye medium for use in a thermal printer is made by applying a layer of dye material to a base layer; softening the applied layer of dyed material, as by heating same, and then calendering the softened, dye-coated base layer.

20 Claims, 6 Drawing Figures

METHOD FOR MAKING A TRANSFERRABLE DYE MEDIUM

This is a continuation of application Ser. No. 400,919, filed 7/22/82 now abandoned.

BACKGROUND OF THE INVENTION

This invention relates to a method and apparatus for making a transferable dye medium that is readily adapted for use in a thermal printer and, more particularly, to a method and apparatus for making such a transferable dye medium that is capable of being re-used several times without noticeable deterioration in the printed image formed therefrom.

A thermal printer capable of printing a "hard copy" of a video image is described in copending application Ser. No. 384,284 now Pat. No. 4,496,955. In that printer, a web of thermally transferable material is advanced between a thermal print head assembly and a record medium. Upon the selective application of heat to the web of thermally transferable material from the thermal print head assembly, the material evaporates from the web, is transferred to the record medium and condenses thereon to form a viewable image. To produce a full color image, the aforementioned web of thermally transferable material is provided with successive sections or areas having thermally transferable material of respectively different colors, such as cyan, magenta and yellow.

The thermally transferable material used in the aforementioned web is a sublimable dye. Various sublimable dyes having the desirable colors may be used in order to form a web of sequential sections or areas as aforesaid.

In one technique for making a web of thermally transferable material, a base layer, such as paper, is coated with suitable dye material. The dye material may be uniformly dispersed in a binder, such as cellulose, and applied as a liquid to the base layer. Thereafter, the dye material is dried, and the resultant dye-coated base layer constitutes the transferable dye medium for use in a printer of the aforementioned type.

In the technique described above for making the transferable dye medium, the dye layer, that is, the layer of dye material which is coated upon the surface of the base layer, may not be uniform. Hence, the density of the dye in certain areas may be greater than in other areas. As a consequence, when this transferable dye medium is used to print a viewable image, an irregular image may result.

Another disadvantage of the transferable dye medium made in accordance with the aforementioned technique resides in the fact that the dye layer merely reposes on the surface of the base layer. Because of this, the bond between the base and dye layers is relatively weak such that most of the dye material is transferred to the record medium upon a single printing operation. Accordingly, the transferable dye medium cannot be re-used many times. This is not economically favorable because a large quantity of the dye medium would be needed in order to carry out several printing operations. Still further, there is a tendency for both the dye layer and the base layer to adhere to the record medium during printing. This may jam or otherwise damage the automatic thermal printing apparatus with which the dye medium is used.

OBJECTS OF THE INVENTION

Therefore, it is an object of the present invention to provide an improved method and apparatus for making a transferable dye medium which can be used with a thermal printer and which overcomes the aforenoted disadvantages.

Another object of this invention is to provide an improved method and apparatus for making a transferable dye medium which can be re-used several times, and which results in good, high quality viewable images during such re-use.

A further object of this invention is to provide a relatively simple and economical method and apparatus for making a transferable dye medium that can be used in a thermal printer.

An additional object of this invention is to provide a method and apparatus for making a transferable dye medium wherein at least a portion of the layer of dye material is impregnated into the base layer therefor.

Various other objects, advantages and features of the present invention will become readily apparent from the ensuing detailed description, and the novel features will be particularly pointed out in the appended claims.

SUMMARY OF THE INVENTION

In accordance with this invention, a method and apparatus are provided for making a transferable dye medium that is readily adapted to be used in a thermal printer for printing a viewable image. A layer of dye material is applied to a surface of a base layer to form a dye-coated base layer, and the applied layer of dye material then is softened, as by heating, and the dye-coated base layer thereafter is calendered. In one embodiment, the layer of dye material is heated and the dye-coated base layer is calendered concurrently. As one example, this is carried out by calender rollers one of which is a heated roller and the other of which is a pressure roller. As a result, the dye layer is impregnated to some depth into the base layer.

In another embodiment, the impregnation of the dye material into the base layer is enhanced by reducing the ambient pressure at the base layer to draw thereinto at least a portion of the applied dye material. The ambient pressure may be reduced by using, for example, a reduced pressure roller over which the base layer passes. A heater may be opposite the reduced pressure roller or spaced upstream thereof so as to soften the dye material and thereby enable the softened material to be drawn into the base layer. After the dye material is softened and impregnated into the base layer, the dye-coated base layer is calendered to remove, or at least reduce, irregularities in the surface of the dye material.

In yet another embodiment, the impregnation of the dye material is enhanced by applying an electric charge to the dye medium and then passing the dye-coated base layer, having the charged dye material thereon, through an electric field such that an electric force is exerted on the charged dye material to urge at least a portion thereof into the base layer. The electric charge may be applied by a corona discharge device; and the electric field may be applied by, for example, moving the dye-coated base layer past a pair of rollers having a suitable electric field generating voltage applied thereacross. Advantageously, one of these rollers also may function as a heater, whereby the charged dye material is softened thereby. Electric charge impregnation of the dye material may be further enhanced by reducing the ambient pressure at the base layer in the vicinity of the electric field through which the dye-coated base layer is passed. This may be achieved by forming the other roller as a reduced pressure roller. Thereafter, the dye-coated base layer having the impregnated dye layer is calendered.

BRIEF DESCRIPTION OF THE DRAWINGS

The following detailed description, given by way of example, will best be understood in conjunction with the accompanying drawings in which.

DETAILED DESCRIPTION OF CERTAIN PREFERRED EMBODIMENTS

Figure 1:
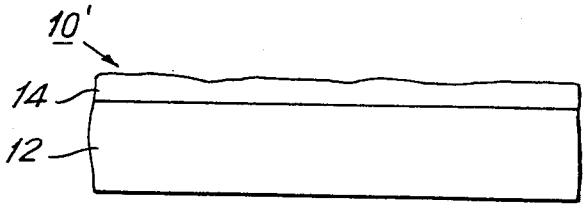
FIG. 1 is a schematic sectional view of the transferable dye medium which is produced in accordance with the earlier technique over which the present invention is an improvement.

Referring now to the drawings, wherein like reference numerals are used throughout, FIG. 1 is a schematic sectional view of a transferable dye medium 10' that is made in accordance with techniques that result in a dye medium having less than desirable properties. Transferable dye medium 10' may be formed as an elongated strip, ribbon or web having a base layer 12, such as paper, whose upper surface (as viewed in FIG. 1) is coated with a layer 14 of dye material. As mentioned above, the dye material preferably is sublimable so as to evaporate when heat is applied thereto, transfer to a record medium disposed adjacent to or in contact with the dye material, and condense on the record medium. Furthermore, the dye material included in dye layer 14 may exhibit a desirable color, such as cyan, magenta or yellow.

The dye material included in dye layer 14 preferably is a sublimable dye that is dispersed in a binder such as ethyl cellulose, or the like. Examples of the dye material are 1-aminoanthraquinone, 2-aminoanthraquinone, 1,4-dihydroxyanthraquinone, 1-amino-2-phenoxy-4-hydroxyanthraquinone, 1,4-diamino-5-nitroanthraquinone, 1,4-diaminoanthraquinone, 1,4,5-triaminoanthraquinone, 1,4,5,8-tetraaminoanthraquinone, 1-amino-2-(4-bromphenoxy)-4-oxyanthraquinone, 4-amino-2-(4-aminophenoxy)-4-oxyanthraquinone, 1-oxy-4-anilinoanthraquinone, C. I. Disperse Orange 13, C. I. Disperse Blue 56 and Dianix Brilliant Red BS-E. Such dye materials exhibit sublimation temperatures at normal (e.g. 1) atmospheric pressures in the range from about 155° C. to about 260° C. depending upon which dye is selected. When heat at or greater than the sublimation temperature is applied, the dye material evaporates to be condensed subsequently on the record medium. Typically, the binder with which the dye is dispersed exhibits a slightly higher melting point than the sublimation temperatures of that dye.

Figure 2:
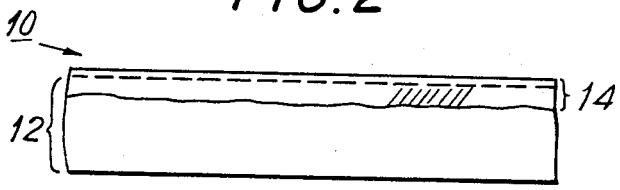
FIG. 2 is a schematic sectional view of the transferable dye medium that is made in accordance with the present invention.

FIG. 2 is a schematic sectional view of transferable dye medium 10 that is formed in accordance with the present invention. It is seen from FIG. 2 that dye layer 14 is impregnated to some depth into the upper surface of base layer 12. The broken line in FIG. 2 represents the upper surface of the base layer; and it is seen that dye layer 14 is coated upon that upper surface and is impregnated therebeneath. Because of this impregnation, the transferable dye medium may be re-used several times without noticeable degradation in the quality of the image formed therefrom. Hence, uniform printing may be attained from this transferable dye medium; and the strip, ribbon or web does not undesirably adhere to the record medium with which it is used.

One embodiment of apparatus which is used in accordance with the present invention to produce transferable dye medium 10 of FIG. 2 now will be described with reference to the schematic illustration thereof in FIG. 3. The illustrated apparatus includes a dye layer applicator, a dryer 26 and calendering rollers 28. Advantageously, base layer 12, which may be paper, is deployed about a roller 24 and is driven in the direction indicated by arrow A, as will be described. Roller 24 is adjacent a dye layer applicator roller 20 which functions to coat the exposed surface of the base layer with a dye layer 14. Applicator roller 20 cooperates with a container 16 of dye material 18, the latter being of the aforementioned material which is uniformly dispersed with a binder. Dye material 18 preferably is in liquid form. Applicator roller 20 is provided with lands 21 and rotates in the counterclockwise direction to pick up dye material from container 16. This material lodges on and in the areas between lands 21; and a blade 22 serves to remove excess dye material from the outer periphery of applicator roller 20. The applicator roller may be a suitable metal roller, platen or drum, such as chromium-plated iron, copper, or the like. A uniform coating of dye material is formed on the periphery of drum 20; and as the drum continues to rotate, this uniform coating is applied to the exposed surface of base layer 12 in the vicinity of roller 24.

Roller 24 rotates with applicator roller 20 to enable a layer of dye material to be transferred from the periphery of the applicator roller to the surface of the base layer as the latter is driven about roller 24. Base layer 12, having dye layer 14 coated thereon, then is advanced past dryer 26. The dryer may be of conventional construction to dry the liquid dye material, resulting in dye-coated base layer 10'.

It may be appreciated that the dye-coated base layer emerging from the vicinity of dryer 26 is of the type illustrated in FIG. 1. This dye-coated base layer then may be further processed directly in order to result in transferable medium 10 shown in FIG. 2 or, alternatively, the dye-coated base layer may be wound in a roll and stored for subsequent processing. For convenience, it is assumed that the dye-coated base layer is processed directly to produce the improved transferable dye medium of FIG. 2.

The processing of dye-coated base layer comprises softening dye layer 14 and then calendering the softened dye-coated base layer. In the embodiment illustrated in FIG. 3, dye layer 14 is softened by the application of heat thereto. Heating of the dye layer advantageously is achieved by means of heated roller 30. As illustrated, heated roller 30 cooperates with pressure roller 32, the combination of these two rollers comprising calendering rollers 28. Hence, the heating of dye layer 14 and the calendering of the softened dye-coated base layer are carried out concurrently. It will, of course, be appreciated that, if desired, dye layer 14 may be heated upstream by other heating means (not shown), and simple pressure rollers may be used as the calendering rollers. As a further alternative, means other than heat may be used to soften dye layer 14. For example, if the illustrated apparatus is included in a continuous process, dye-coated base layer 10' emerging from dryer 26 might be such that the dye layer is not fully dry and, moreover, may be in a softened condition.

Figure 3:
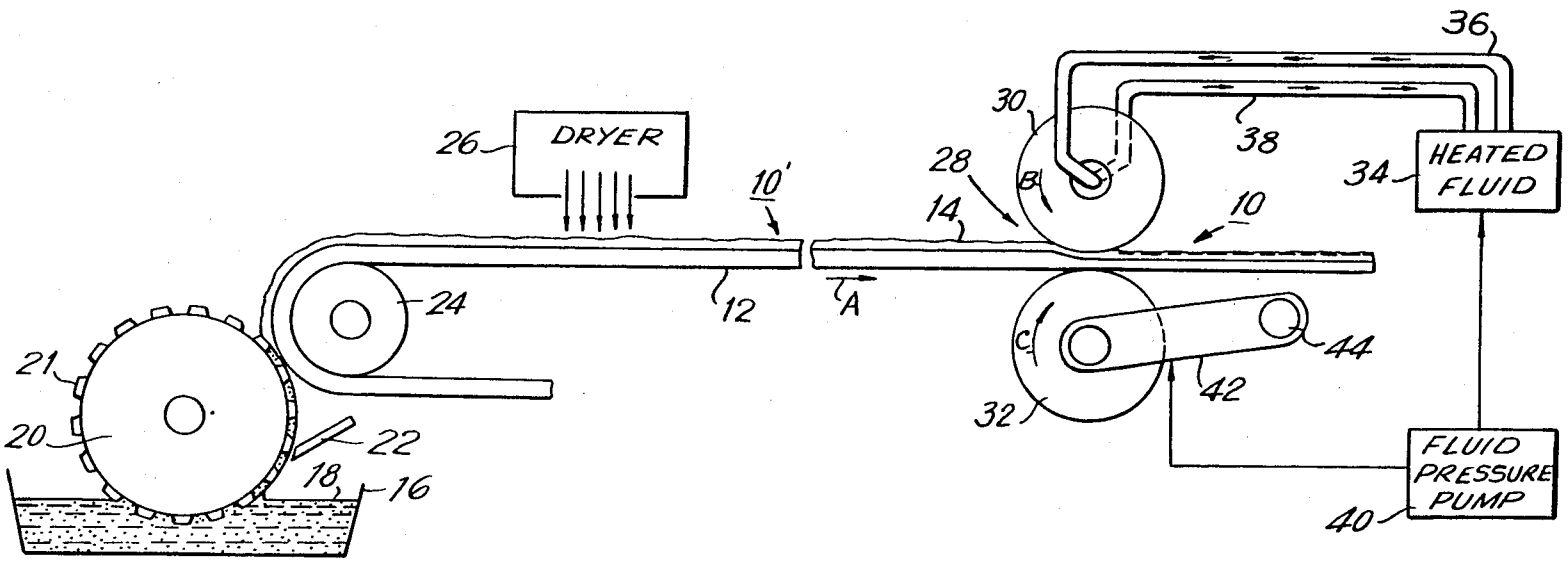
FIG. 3 is a schematic diagram of one embodiment of apparatus which is used to carry out the present invention.

In the embodiment shown in FIG. 3, calendering roller 30 preferably is of the type that is heated by means of a fluid supplied thereto. A source of heated fluid 34 is coupled by way of a supply conduit 36 to heated roller 30, and a return conduit 38 supplies relatively cooled fluid to source 34 whereat the fluid is heated and once again supplied to the heated roller. As an example, the fluid used to heat roller 30 may comprise oil heated with steam, or other conventional heatable hydraulic fluids.

Pressure roller 32 may comprise a metal roller and, preferably, is rotatably supported on a pivotable arm 42, the latter being pivotable about a pivot bearing 44. A fluid pressure pump 40 is coupled by conventional hydraulic means to pivotable arm 42 so as to urge that arm in the clockwise direction and thereby urge pressure roller 32 toward heated roller 30. Advantageously, fluid pressure pump 40 may use the same hydraulic fluid as used to heat roller 30 and, thus, may serve the dual function of driving pivotable arm 42 as well as pumping the heated fluid to heated roller 30 from source 34.

Preferably, heated roller 30 may be a chromium-plated iron roller and is adapted to apply heat to dye layer 14 at a temperature below the evaporation temperature of the dye material and the melting temperature of the binder with which that dye material is dispersed. As an example, heat roller 30 is heated to a temperature on the order of about 100°-150° C., which is well below the evaporation temperature of the dye material and the melting temperature of the binder but is sufficient to soften the dye layer.

Pressure roller 32 need not be limited solely to a metal roller. Other conventional materials normally used in calendering rollers may be used as the pressure roller.

As is apparent from FIG. 3, heated roller 30 serves to soften the dye material; and the pressure exerted on the softened dye-coated base layer by the combination of the heated roller and pressure roller 32 serves to smooth the dye layer and urge, or squeeze, that layer to a limited depth into base layer 12.

As an example, the pressure exerted by calendering rollers 28 (i.e. the combination of heated roller 30 and pressure roller 32) may be on the order of about 20 kg./cm$^2$ to 200 kg./cm$^2$. Also, heated roller 30 and pressure roller 32 may be rotatably driven by suitable motor means (not shown) so as to advance the dye-coated base layer in the direction of arrow A at a speed on the order of about 5 to 30 cm/sec.

Figure 4:
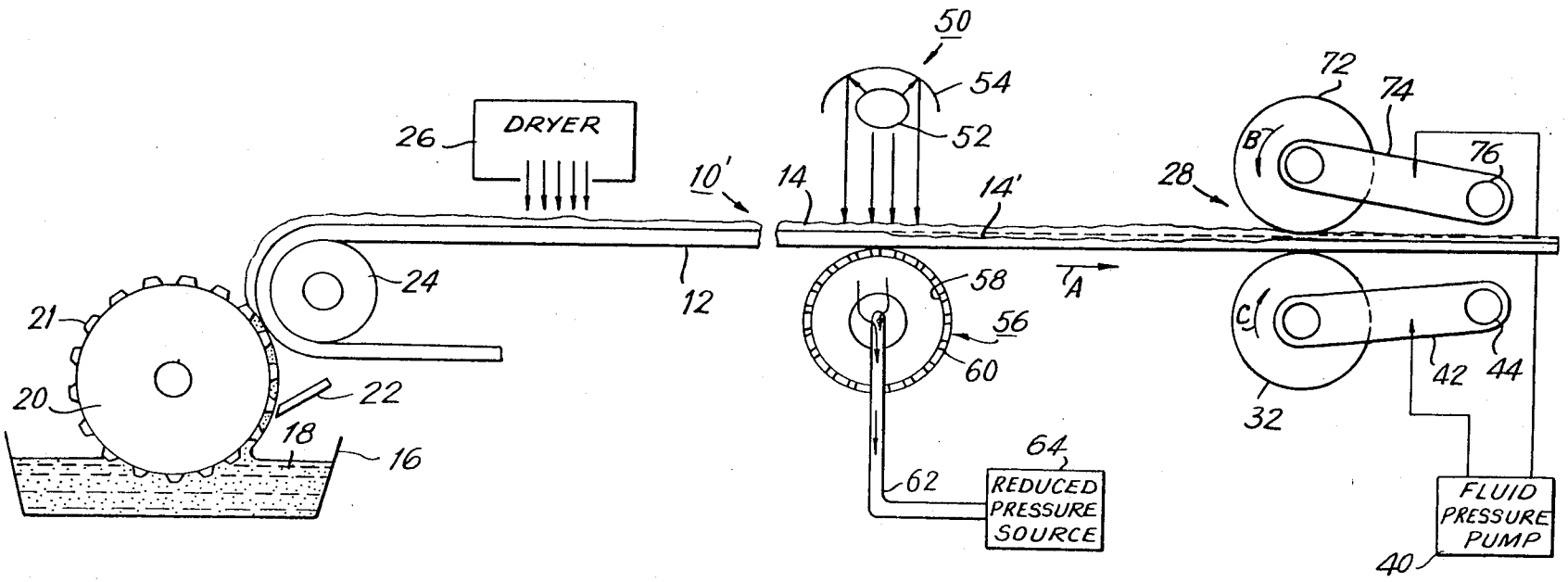
FIG. 4 is a schematic diagram of another embodiment of apparatus which is used to carry out this invention.

In the embodiment of FIG. 3, there is the possibility that some of the dye material might adhere to the surface of heated roller 30. Such adherent dye material may be removed, as by a suitable scraper blade or other treatment for the heated roller as the latter rotates. In an alternative embodiment, heat is applied by other means upstream of calendering rollers 28. For example, an infrared heater may be used to heat and, thus, soften dye layer 14. An example of such an infrared heater is illustrated in FIG. 4. As shown, infrared heater 50 is positioned upstream of calendering rollers 28 such that dye-coated base layer 10' passes this infrared heated prior to being received by the calendering rollers. Typically, infrared heater 50 may comprise an infrared heat source 52 partially surrounded by a reflector 54 such that infrared heat is directed to dye layer 14.

It will be appreciated that the means by which dye layer 14 is applied to the surface of base layer 12 is substantially similar to that shown in FIG. 3. In the interest of brevity, further description of this means is not provided.

FIG. 4 also illustrates means to enhance the impregnation of dye layer 14 into base layer 12. In this embodiment, such means is comprised of a reduced pressure roller 56 which is adapted to reduce the ambient pressure at base layer 12 so as to draw, or suck, at least a portion of dye layer 14 into the base layer. As schematically illustrated in FIG. 4, dye layer 14 is impregnated into base layer 12 to a depth 14' as the dye-coated base layer emerges from the vicinity of reduced pressure roller 56.

One embodiment of the reduced pressure roller is described further below with respect to FIG. 6. It will be appreciated that the reduced pressure roller is formed as a substantially hollow roller having perforations 58 in the surface thereof to communicate with its interior. The hollow interior of reduced pressure roller 56 communicates with a reduced pressure source 64, such as a vacuum pump or the like, by means of a conduit 62. The reduced pressure source reduces the pressure at the interior of roller 56; and perforations 58 communicate this reduced pressure to the immediate exterior of the roller. Since base layer 12 is adjacent to or in contact with roller 56, the ambient pressure at the base layer and, particularly, the lower surface thereof (that is, the surface of the base layer which is opposite the surface upon which dye layer 14 is coated) has a reduced pressure. This reduced pressure tends to draw softened dye layer 14 into the base layer. It is recognized that, if base layer 12 is formed of paper, the dye material is drawn into the interstices of the fibers of that paper.

In one embodiment of reduced pressure roller 56, perforations 58 are relatively small. However, if such perforations are larger, smooth movement of the dye-coated base layer over the reduced pressure roller may be impeded. Thus, a fibrous sleeve 60 may be provided over the outer surface of roller 56.

As an example, reduced pressure source 64 may reduce the pressure in the interior of roller 56 from normal atmospheric pressure of about 760 mm. Hg to 300 mm. Hg.

As an alternative, reduced pressure roller 56 may be replaced by a fixed vacuum plenum over which base layer 12 passes. The reduced pressure roller is preferred, however, because it facilitates smooth and uniform movement of the dye-coated base layer in the direction A.

Although heater 50 is illustrated as an infrared heater, it will be appreciated that, if desired, other heating devices may be used, such as a fixed member positioned above dye layer 14 and heated by, for example, electricity, a heated fluid, or the like. Preferably, the heat generated by heater 50 is on the order of 100°-150° C. and, in any event, is less than the evaporation temperature of the dye material and less than the melting temperature of the binder. Although FIG. 4 illustrates heater 50 as being juxtaposed reduced pressure roller 56, it should be recognized that the heater may be spaced from the reduced pressure roller so as to be positioned relatively upstream thereof.

Dye-coated base layer 10', having dye layer 14' melted and impregnated to a depth into base layer 12 then is advanced to calendering rollers 28. The calendering rollers in this embodiment may be substantially identical to each other and are illustrated as pressure rollers 32 and 72 rotatably mounted on pivotable arms 42 and 74, respectively, these arms being pivoted about respective pivot bearings 44 and 76. Fluid pressure pump 40, described hereinbove, may be used to pivot arms 42 and 74 so as to urge pressure rollers 32 and 72 toward each other end, thus, calender the softened dye-coated base layer that is advanced thereto.

The embodiment shown in FIG. 4 avoids difficulties which may arise due to the adherence of dye material to the heated roller shown in FIG. 3. Although dye layer 14' is softened as the dye-coated base layer approaches calendering rollers 28, the fact that neither pressure roller 32 nor pressure roller 72 is heated avoids adherence of the softened dye material thereto.

The embodiment shown in FIG. 4, together with the various modifications thereof described above, enhances and improves the impregnation of the dye layer into the base layer. Thus, the strip, ribbon or web of transferable dye medium may be re-used several times without noticeable degradation in the quality of the image printed therefrom, and without any undesired "sticking" of the transferable dye medium of the record medium.

Figure 5:
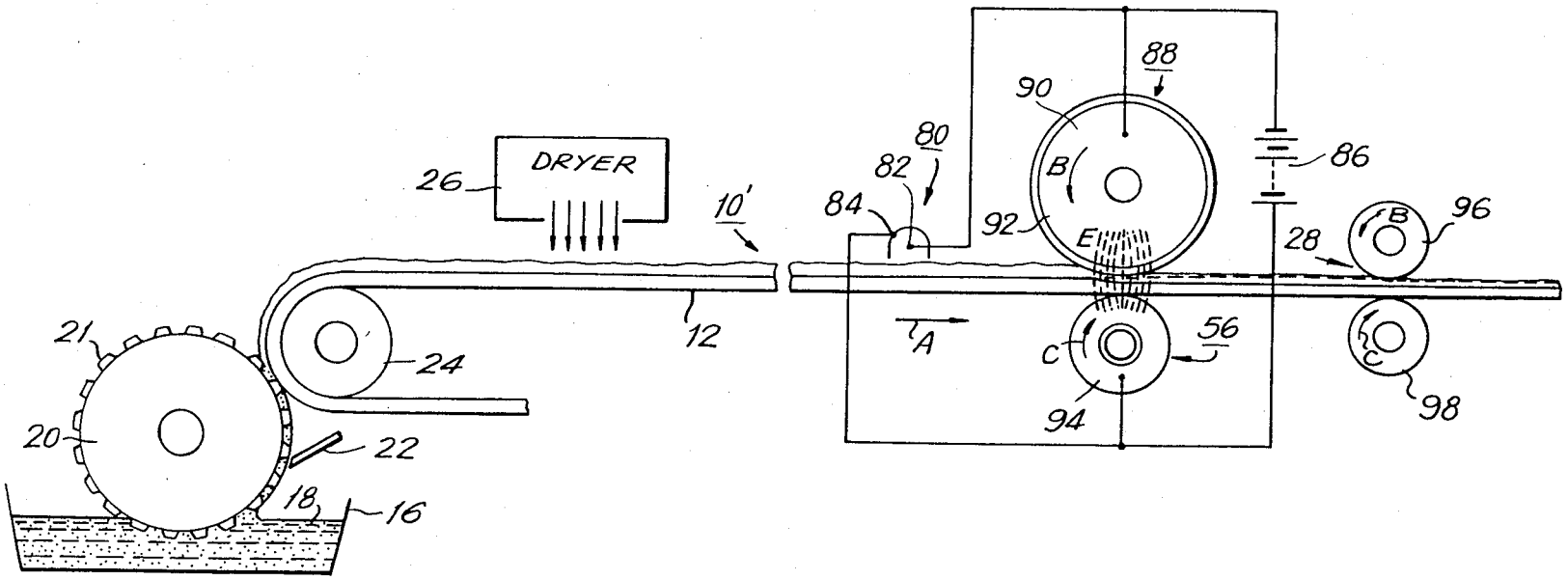
FIG. 5 is a schematic diagram of a still further embodiment of apparatus which is used to carry out the instant invention.

In the embodiment shown in FIG. 4, impregnation of dye layer 14 into base layer 12 is effected, at least in part, by reducing the ambient pressure at base layer 12. Another impregnation means that is alternative to, or may supplement, this reduced pressure technique is illustrated in FIG. 5 as comprising apparatus for applying an electrical charge to the dye layer, and then urging the charged dye layer into base layer 12 by subjecting the charged dye material to an electric force. In this embodiment, the means by which dye layer 14 is applied to base layer 12 may be substantially the same as used in the embodiment of FIG. 3.

The electrical charge which is applied to dye layer 14 is generated by, for example, a corona discharge device 80. This corona discharge device may be of conventional construction including a corona electrode 82 partially surrounded by a shield electrode 84. A suitable high voltage source 86 which may be, for example, on the order of 5 Kv–15 Kv is coupled to corona discharge device 80 so as to generate a negative corona and, thus, apply a negative charge to the dye material. Hence, corona electrode 82 is supplied with relatively negative voltage and shield electrode 84 is supplied with relatively positive voltage. It will be appreciated that, when corona discharge device 80 generates its corona discharge, as by the closing of a switch or other suitable device to supply the aforementioned high electrical voltage across the corona and shield electrodes, negatively charged ions will be directed to dye layer 14. In the illustrated embodiment, the dye layer is dry and, thus, the dried dye layer is negatively charged. Although not shown, a ground roller or a plate may be aligned with corona discharge device 80 and positioned therebeneath (as viewed in FIG. 5) such that the lower surface of base layer 12 is in contact therewith. This ground roller or plate enhances the corona charging of dye layer 14.

Positioned downstream of corona discharge device 80 is a combined heater/electric field generator. In this embodiment, a heating roller 88 preferably is formed as a conductive roller 90 having an electrically insulating layer 92 disposed on the surface thereof. The conductive roller is electrically coupled to the negative terminal of high voltage source 86. The heating roller may be heated electrically or by means of a suitable heating fluid, such as discussed above with respect to the embodiment shown in FIG. 3. As illustrated, the outer periphery of the heating roller is in contact with dye layer 14 so as to apply heat thereto and, thus, soften the dye layer.

Base layer 12 is adapted to receive a reference potential and, in the illustrated embodiment, a conductive roller 94 is in contact with the lower surface of the base layer. This conductive roller is seen to be coupled to the positive terminal of high voltage source 86. The high voltage source preferably is a DC source so as to generate a DC electric field E across conductive rollers 90 and 94, respectively. This field exerts an electric force on the charged dye layer that is transported between rollers 90 and 94. Since roller 90 also serves to soften the dye layer as, for example, by heat, the charged, softened dye material is electrically urged into base layer 12 by means of the electric field E that is generated across the rollers.

Dye-coated base layer 10', having dye layer 14 impregnated thereinto, then is calendered by means of calendering rollers 28. These calendering rollers may be similar to those shown in FIG. 4 or, alternatively, may be comprised of a pressure roller 96 having an elastomer surface in contact with dye layer 14, and a metal pressure roller 98 in contact with base layer 12. As mentioned above, the calendering pressure applied to calendering rollers 28 may be on the order of about 20 kg./cm$^2$ to 200 kg./cm$^2$.

As an alternative to conductive roller 94, a fixed conductive plate, bar or the like may be used. This alternative member may be supplied with a reference potential or, alternatively, may be coupled to the positive terminal of high voltage source 86.

As a further alternative, a heater, such as infrared heater 50, may be disposed downstream of corona discharge device 80, and roller 90 may be replaced by a simple conductive roller, an electrically conductive plate, bar, or the like. It is sufficient that the heater softens the charged dye layer, and that the field generating means used as an alternative to conductive rollers 92 and 94 generate a suitable electric field E so as to urge the charged, softened dye material into base layer 12.

To further enhance the impregnation of dye layer 14 into base layer 12, conductive roller 94 may be formed as a reduced pressure roller similar to reduced pressure roller 56. Consequently, the charged, softened dye material is urged into base layer 12 under the combined influence of reduced ambient pressure and an electrical force.

It is appreciated that suitable high voltage generating means (not shown) may be used to generate the high DC voltages which are used in the illustrated embodiment to produce the DC field across rollers 90 and 94.

Figure 6:
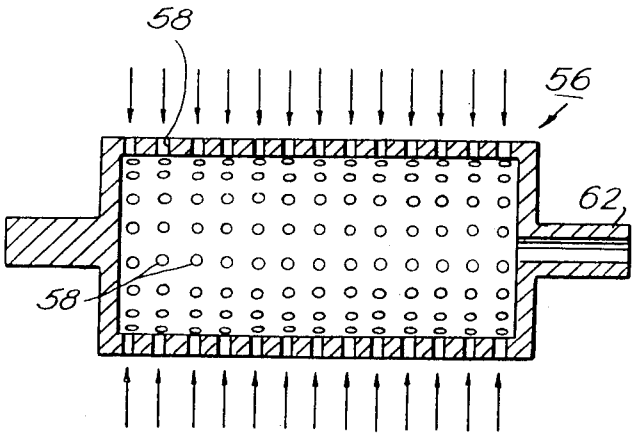
FIG. 6 is a sectional view of a reduced pressure roller that may be used with the present invention.

Reduced pressure roller 56 used in the embodiments of FIGS. 4 and 5 is illustrated schematically in FIG. 6. It is seen that the reduced pressure roller is substantially hollow having perforations 58 for communicating between the hollow interior thereof and the ambient. Conduit 62 supplies a reduced pressure (described above to be on the order of, for example, 300 mm. Hg) to the interior of the roller. Thus, the pressure at the surface of roller 56 also is reduced. Since base layer 12 is in contact with the surface of the roller, the pressure at the base layer is reduced, thereby exerting a negative pressure force to draw at least a portion of softened dye layer 14 into base layer 12. In FIG. 6, fibrous sleeve 60 has been omitted in order to simplify the illustration. It will be recognized that roller 56 may be formed of electrically conductive material so as to be used in conjunction with conductive roller 90 to generate the electric field in the embodiment of FIG. 5.

In the embodiment of FIG. 5, it is preferred to provide electrically insulating layer 92 on the surface of conductive roller 90. Also, if fibrous sleeve 60 is provided about conductive roller 94, this fibrous sleeve also should be of electrically insulating material.

Thus, in the embodiment of FIG. 5, dye layer 14 is impregnated into base layer 12, and the thus-impregnated dye-coated base layer 10' is calendered by calendering rollers 28.

While the present invention has been particularly shown and described with reference to certain preferred embodiments thereof, it will be readily appreciated by those or ordinary skill in the art that various changes and modifications in form and details may be made without departing from the spirit and scope of the invention. For example, the means by which dye layer 14 is applied to base layer 12 may be of the type used in, for example, conventional gravure printing, offset printing, lithographic printing, or the like. Also, the materials used as and with calendering rollers 28 may be of the type normally used for calendering purposes. Also, and as mentioned above, although heat is preferred for softening dye layer 14 prior to impregnation and calendering, other softening means compatible with the dye materials used with the present invention may be adopted. It is intended that the appended claims be interpreted as including the foregoing as well as various other changes and modifications.

What is claimed is:

1. A method of making a thermally transferable dye medium for a thermal printer comprising the steps of:

providing a base layer;

coating a surface of said base layer with a dye layer comprised of a sublimable dye material dispersed in a binder and having a sublimation temperature less than a melting temperature of said binder to form a dye-coated base layer;

drying said dye layer on said base layer;

heating said dried dye layer at a temperature less than either of said melting and sublimation temperatures, thereby to soften said dried dye layer; and calendering said softened dried dye-coated base layer so as to cause impregnation of at least a portion of said dye layer into said base layer.

2. The method of claim 1 wherein said step of calendering comprises passing said dye-coated base layer between pressure roll means.

3. The method of claim 2 wherein said steps of heating and calendering are carried out concurrently.

4. The method of claim 3 wherein one of said pressure roll means comprises a heated roller.

5. The method of claim 2 wherein said impregnation is enhanced by sucking said at least portion of said dye layer into said base layer.

6. The method of claim 5, wherein said step of sucking comprises reducing the ambient atmospheric pressure at the side of said base layer on which no dye layer is coated to draw thereinto said at least portion of the dye layer applied to said surface of said base layer.

7. The method of claim 6, wherein said step of reducing the ambient atmospheric pressure at said base layer comprises the further steps of passing said dye-coated base layer over a roller and reducing the atmospheric pressure within said roller to less than ambient atmospheric pressure.

8. The method of claim 7 wherein the surface of said base layer that is opposite the surface on which said dye layer is applied is in facing relationship with said reduced-pressure roller.

9. The method of claim 8 wherein said steps of heating and reducing the ambient pressure at said base layer are carried out concurrently.

10. The method of claim 8 wherein said step of heating precedes said step of reducing the ambient pressure at said base layer.

11. The method of claim 6 wherein said step of heating comprises applying infra-red heat to said applied dye layer.

12. The method of claim 2 wherein said impregnation is enhanced by applying an electric charge to said dye layer; and applying an electric force to the softened, charged dye layer to urge said at least a portion thereof into said base layer.

13. The method of claim 12 wherein said step of applying an electric charge to said dye layer comprises passing said dye-coated base layer past a corona discharge device prior to the heating of said dye layer.

14. The method of claim 13 wherein said step of applying an electric force comprises passing said dye-coated base layer having the charged dye layer over an electrical reference.

15. The method of claim 14, further comprising the step of reducing the ambient pressure at said base layer concurrently with passing said dye-coated base layer over said electrical reference to apply an additional mechanical force to said softened, charged dye layer.

16. The method of claim 15 wherein said steps of passing said dye-coated base layer over an electrical reference and reducing the ambient pressure at said base layer are carried out by reduced pressure roll means having a predetermined electrical reference potential applied thereto.

17. The method of claim 12 wherein said step of heating comprises passing said dye-coated base layer past heat roll-means.

18. The method of claim 17 wherein said electric charge is applied to said dye layer before said dye-coated base layer passes said heat roll means.

19. The method of claim 18 wherein said step of applying an electric force comprises applying a predetermined electrical voltage to said heat roll means while concurrently passing said dye-coated base layer over an electrical reference.

20. The method of claim 17 wherein said step of applying an electric force comprises passing said dye-coated base layer having the softened, charged dye layer through an electric field of polarity to urge said at least portion of said charged dye layer into said base layer.

* * * * *